US005829131A

United States Patent [19]

DeSloover et al.

[11] Patent Number: 5,829,131

[45] Date of Patent: Nov. 3, 1998

[54] METHOD OF MAKING CAMSHAFT LOBES

[75] Inventors: John W. DeSloover, Monroe; Bradley Cowan, Novi, both of Mich.

[73] Assignee: Chrysler Corporation, Auburn Hills, Mich.

[21] Appl. No.: 976,032

[22] Filed: Nov. 21, 1997

[51] Int. Cl.[6] ..... B23P 15/00

[52] U.S. Cl. ..... 29/888.1; 451/32; 451/328

[58] Field of Search ..... 29/888.1; 451/32, 451/34, 35, 37, 328

[56] References Cited

U.S. PATENT DOCUMENTS

| | | | |
|---|---|---|---|
| 2,476,540 | 7/1949 | Fraser | 451/328 |
| 2,683,343 | 7/1954 | Gillette et al. | 51/282 |
| 2,912,803 | 11/1959 | Simjian | 51/281 |
| 2,947,124 | 8/1960 | Madigan et al. | 51/282 |
| 2,978,850 | 4/1961 | Gleszer | 51/282 |
| 2,994,165 | 8/1961 | Brevik | 451/32 |
| 3,256,643 | 6/1966 | Sudarsky | 451/32 |
| 3,528,201 | 9/1970 | Jones et al. | 51/164 |
| 3,579,933 | 5/1971 | Snell | 51/315 |
| 3,848,373 | 11/1974 | Pletscher | 51/313 |
| 4,003,164 | 1/1977 | Carpenter, Jr. et al. | 51/13 |
| 4,115,960 | 9/1978 | Zecher | 451/328 |
| 4,753,046 | 6/1988 | Thonney | 51/164.1 |
| 4,969,262 | 11/1990 | Hiraoka | 29/888.1 |
| 5,195,229 | 3/1993 | Hughes | 29/888.1 |
| 5,272,930 | 12/1993 | Nakamura et al. | 29/888.1 |
| 5,497,679 | 3/1996 | Mitchell et al. | 29/888.1 |
| 5,643,054 | 7/1997 | Bach et al. | 451/34 |

OTHER PUBLICATIONS

Auto Industry Newsletter, Jan. 1997, vol. 19, No. 213, pp. 1–2.

*Primary Examiner*—I. Cuda
*Attorney, Agent, or Firm*—Lawrence J. Shurupoff

[57] ABSTRACT

Sharp edges formed during forging are removed from cam lobes by tumbling prior to machining of mounting bores which have been rough formed by punching. Tumbling effectively removes the sharp edges from non-hardened steel and prevents the formation of burrs caused by prior grinding techniques.

7 Claims, 1 Drawing Sheet

METHOD OF MAKING CAMSHAFT LOBES

BACKGROUND OF THE INVENTION

1. Field of the Invention

The present invention relates to camshafts for internal combustion engines, and particularly to a method of removing burrs from forged cam lobes.

2. Description of Prior Developments

Composite camshafts have been constructed by forming individual cam lobes and mounting the lobes to a shaft. A problem has been encountered during the forging or stamping of the lobes wherein relatively large ridges or burrs have been formed around the edges of the lobes.

Although subsequent surface grinding is applied to the lobes, the burrs are simply pushed to one side and are not removed. Subsequent surface polishing has also failed to effectively remove the burrs.

More costly grinding methods can be used to remove the burrs, however, such grinding is economically unfeasible. Accordingly, a need exists for an inexpensive and efficient method for removing burrs from forged or die formed cam lobes.

SUMMARY OF THE INVENTION

The present invention has been developed to fulfill the needs noted above and therefore has an object the efficient and inexpensive removal of burrs from cam lobes. This is achieved by using a tumbling process to remove the burrs and form a chamfer or radius on the edges of the cam lobes.

Although conventional thought has considered tumbling unsuitable for processing precision parts such as cam lobes, it has been discovered that with a proper sequence of finishing procedures, tumbling is an extremely cost efficient and suitable solution to the problem. Even though tumbling has been considered a relatively uncontrollable process with little ability to maintain close tolerances and dimensions, by a proper sequence of processing, tumbling has been found advantageous in the manufacturing of cam lobes.

The tolerance control problem has been overcome by performing tumbling for burr removal before the cam lobes are machined, broached, ground and polished. It has also been found particularly advantageous to perform tumbling on a formed cam lobe prior to heat treatment so that tumbling time can be reduced to a minimum with minimal use and depletion of tumbling media.

DETAILED DESCRIPTION OF THE PREFERRED EMBODIMENT

Figure 1:
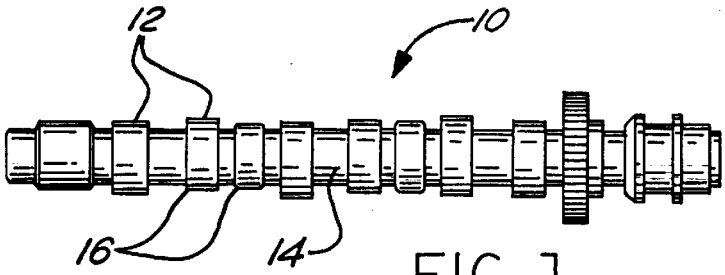
FIG. 1 is a schematic view of a camshaft constructed in accordance with the prior art.
Figure 2:
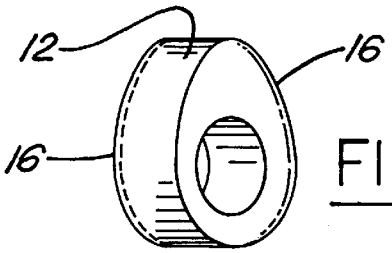
FIG. 2 is an enlarged perspective view of one of the cam lobes of FIG. 1 showing the location of burrs on the edges of the lobe.

The present invention will now be described in conjunction with the drawings beginning with FIG. 1 which shows a conventional composite camshaft 10 fabricated from a plurality of individual cam lobes 12 mounted on a cylindrical shaft 14. Undesirable burrs 16 are present on each lobe 12 as seen more clearly in FIG. 2. Such burrs can break away from the lobes during use and cause damage to soft internal engine components such as bushings, bearings and thrust washers.

Figure 3:
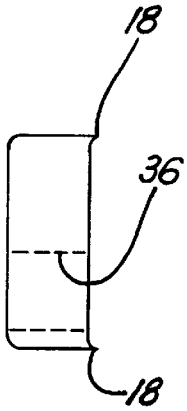
FIG. 3 is a side view of a forged cam lobe after removal from a forming die.
Figure 4:
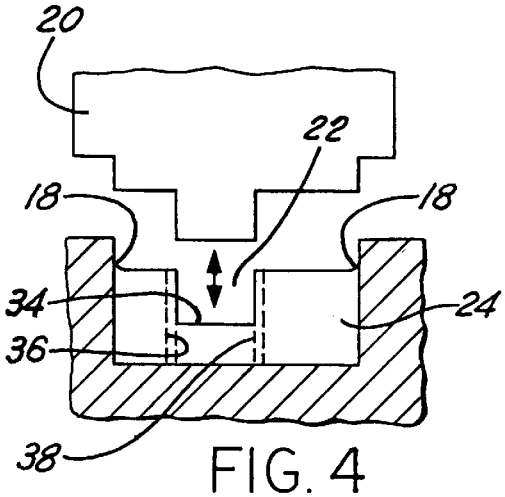
FIG. 4 is a view of a cam lobe in an intermediate stage of fabrication in accordance with the invention.

The burrs 16 have been found to originate from the forging or coining operation during which the lobes are formed from unhardened, somewhat coin-shaped steel slugs or preforms cut from unhardened steel rods. As seen in FIG. 3 and FIG. 4, a ridge 18 is formed around the upper edge of the lobe 12 as punch 20 forms a recess 22 in slug 24. The material displaced by punch 20 forces the preform to flow outwardly against the walls of the die. Prior attempts to remove the ridge 18 by conventional grinding of the outer diameter of the cam merely enlarged the ridge and created burrs.

Figure 5:
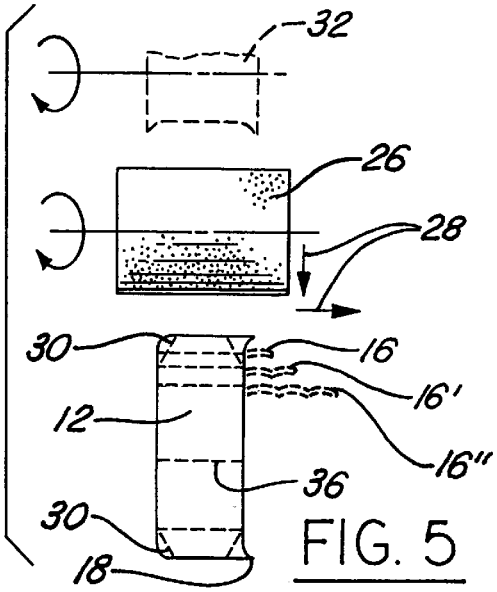
FIG. 5 is a side view of the cam lobe of FIG. 3 schematically showing the inability of a conventional grinder to remove burrs.

As seen in FIG. 5, as grinding wheel 26 passes inwardly and over the surface of the cam lobe, as represented by the directional arrows 28, the ridge 18 is merely pushed over and fails to break away. This causes the formation of burrs 16. It is believed that this is due to the presence of a relatively soft decarburized layer of steel formed on the surface of slug 24. This unhardened surface layer is not sufficiently brittle to break away. In some cases, grinding can produce burrs on the edges of both flat faces of lobe 12.

Subsequent passes of the grinding wheel 26 merely increase the size of burr 16 as shown at 16' and 16". Although chamfers 30 could be ground on the edges of cam lobe 12 with a plunge grinder 32 so as to remove ridges 18 and any burrs 16, such grinding is extremely expensive.

Instead of grinding chamfers 30, the present invention relies on a tumbling procedure to remove the ridges without creating additional burrs. The tumbling process used in accordance with the invention is about one-tenth the cost of machining chamfers on the lobes such as by milling.

Returning to FIG. 4, once recess 22 is formed in slug 24, a second punch punches out floor 34 along shear line 38. After this second punching operation and before subsequent broaching of mounting hole 36 and before heat treating of the cam lobe, a tumbling operation is used to break off ridge 18 without forming burrs.

A conventional tumbling drum is filled with several hundred cam lobes in the condition as formed in a forge, i.e. without drilling, broaching, or any other machining. The lobes are mixed with tumbling media in the drum and tumbled in a known fashion. It has been found advantageous to use cone-shaped tumbling media known as LWS composite media.

Figure 6:
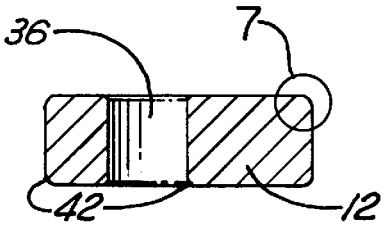
FIG. 6 is a view of the cam lobe of FIG. 5 after tumbling.
Figure 7:
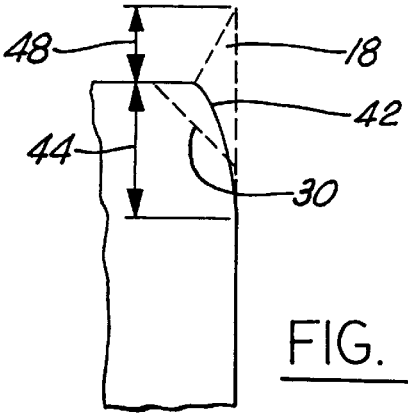
FIG. 7 is a fragmental enlarged view of the tumbled edge of region 7 of FIG. 6.

Tumbling time can extend from four hours up to twenty hours, with fifteen hours being found satisfactory in most cases. After tumbling, the lobes have nicely rounded edges 42 as seen in FIGS. 6 and 7. In FIG. 7, the tumbled profile 42 is compared with a standard ground chamfer 30. The projected length 44 of the arcuate or curved edge along profile 32 formed according to one embodiment of the invention is about 0.030 inch, with removed ridge 18 having a height 48 of about 0.020 inch.

After tumbling, the lobes are machined wherein mounting hole 36 is finished by boring and broaching. Axial splines can be broached on the surface of mounting hole 36 to secure the lobe on shaft 14. At this point, the lobes are hardened by conventional heat treatment known in the art. After hardening, the lobes are assembled on a shaft and then ground to a fine surface finish and thereby accurately sized and profiled.

A further polishing of the lobes using grit tape is carried out in a known manner to give the lobe running surface a highly polished smooth running surface. Because the tumbling is carried out before broaching and accurate sizing of the bore of mounting hole 36, the relative difficulty of controlling dimensions and tolerances with tumbling is of little consequence, since the accuracy of bore 36 and the surface of the lobes 12 is controlled by subsequent highly accurate machining techniques.

It should be understood that while this invention has been discussed in connection with one particular example, those skilled in the art will appreciate that other modifications can be made without departing from the spirit of this invention after studying the specification, drawings, and the following claims.

We claim:

1. A method of making a camshaft lobe, comprising;

placing a steel preform in a die;

forming a recess in said preform in said die while shaping said preform into a cam lobe;

forming a bore through said recess;

tumbling said cam lobe in tumbling media and forming smooth edges on said cam lobe;

heat treating said cam lobe in an oven so as to harden said cam lobe; and grinding a surface finish on said cam lobe.

2. The method of claim 1, further comprising machining a mounting surface around said bore after said tumbling.

3. The method of claim 2, wherein said mounting surface is machined prior to said heat treating.

4. The method of claim 2, wherein said machining comprises boring.

5. The method of claim 2, wherein said machining comprises broaching.

6. The method of claim 1, further comprising polishing said cam lobe after said grinding.

7. The method of claim 1, wherein said bore is formed by punching.

* * * * *